US009414989B2

(12) United States Patent
Ziemba et al.

(10) Patent No.: US 9,414,989 B2
(45) Date of Patent: Aug. 16, 2016

(54) PHARMACEUTICAL PRODUCT CONTAINER WITH PERMANENT LOCKING MECHANISM

(71) Applicant: Mallinckrodt LLC, Hazelwood, MO (US)

(72) Inventors: Robert J. Ziemba, Cincinnati, OH (US); Vernon D. Ortenzi, Burlington, KY (US)

(73) Assignee: MALLINCKRODT LLC, Hazelwood, MO (US)

( * ) Notice: Subject to any disclaimer, the term of this patent is extended or adjusted under 35 U.S.C. 154(b) by 121 days.

(21) Appl. No.: 14/488,048

(22) Filed: Sep. 16, 2014

(65) Prior Publication Data

US 2015/0001102 A1 Jan. 1, 2015

Related U.S. Application Data

(62) Division of application No. 13/103,203, filed on May 9, 2011, now abandoned.

(60) Provisional application No. 61/332,969, filed on May 10, 2010.

(51) Int. Cl.

| | |
|---|---|
| ***A61J 1/14*** | (2006.01) |
| ***E05B 73/00*** | (2006.01) |
| ***B65D 45/00*** | (2006.01) |
| ***A61J 1/03*** | (2006.01) |
| ***B65D 55/12*** | (2006.01) |

(52) U.S. Cl.

CPC *A61J 1/1437* (2013.01); *A61J 1/03* (2013.01); *A61J 1/14* (2013.01); *B65D 45/00* (2013.01); *B65D 55/12* (2013.01); *E05B 73/0023* (2013.01); *B65D 2255/20* (2013.01)

(58) Field of Classification Search

CPC ..... A61J 1/14; E05B 73/0023; B65D 45/00; B65D 45/28; B65D 2255/00; B65D 2255/06; B65D 2255/20

See application file for complete search history.

(56) References Cited

U.S. PATENT DOCUMENTS

| | | | |
|---|---|---|---|
| 3,926,325 | A | 12/1975 | Benson |
| 4,445,622 | A | 5/1984 | Sideri |
| 4,877,150 | A | 10/1989 | Otto et al. |
| 4,878,595 | A | 11/1989 | Uhlig et al. |
| 5,000,332 | A | 3/1991 | Whitacre |
| 5,123,556 | A | 6/1992 | Goldenberg |
| 6,612,450 | B1 | 9/2003 | Buono |

*Primary Examiner* — Andrew Perreault

(74) *Attorney, Agent, or Firm* — Marsh Fischmann & Breyfogle LLP

(57) ABSTRACT

Various embodiments of pharmaceutical product containers are disclosed. Each pharmaceutical product container includes a cap, a container body, and a locking mechanism. The locking mechanism is disposable from a locked state to an unlocked state at least when the cap is in a closed position relative to the container body (e.g., to define an enclosed space for pharmaceutical product). Once in the locked state and with the cap being in a closed position, the locking mechanism is unable to return to its unlocked state. Pharmaceutical product enclosed within the container with the locking mechanism being in its locked state may then be disposed of in any appropriate manner (e.g., discarded in the trash).

7 Claims, 10 Drawing Sheets

PHARMACEUTICAL PRODUCT CONTAINER WITH PERMANENT LOCKING MECHANISM

CROSS-REFERENCE TO RELATED APPLICATIONS

This patent application is a divisional application of co-pending U.S. patent application Ser. No. 13/103,203, entitled "PHARMACEUTICAL PRODUCT CONTAINER WITH PERMANENT LOCKING MECHANISM," and filed on May 9, 2011, which is a non-provisional application of U.S. Provisional Patent Application Ser. No. 61/332,969, entitled "PHARMACEUTICAL PRODUCT CONTAINER WITH PERMANENT LOCKING MECHANISM," and filed on May 10, 2010 (expired). Priority is claimed to each patent application set forth in this Cross-Reference to Related Applications section, and the entire disclosure of each patent application set forth in this Cross-Reference to Related Applications section is hereby incorporated by reference.

FIELD OF THE INVENTION

The present invention generally relates to the field of packaging for pharmaceutical products such as pills, capsules, and the like and, more particularly, to packaging arrangements that facilitate the disposal of pharmaceutical product (e.g., to reduce the potential of illicit usage of unused pharmaceutical product).

BACKGROUND

Abuse, misuse, and overdose of pharmaceutical products (e.g., pain management drugs) are serious health concerns that affect many people on a daily basis all over the world. For instance, diversion and subsequent misuse or abuse may occur when a patient gets a prescription for a pharmaceutical product and does not use all of the pharmaceutical product for whatever reason (e.g., a doctor may prescribe a pharmaceutical product for a patient and advise the patient to take the pharmaceutical product on an "as needed" basis; a patient may be advised to use an entire prescribed amount of pharmaceutical product, but may unilaterally decide to discontinue use of the pharmaceutical product as one or more symptoms disappear). In any case, remaining pharmaceutical product may be ultimately acquired by an individual other than for whom the pharmaceutical product was originally prescribed (e.g., transferred by the original patient to another individual, such as family member or friend; stolen). While unused pharmaceutical product may be disposed of in the trash, this may not be viewed by some as a secure method of disposal.

In the case of transdermal analgesic patches, a used patch may still retain a significant amount of active ingredient in the patch. A used patch can be very dangerous and can even lead to death for people who have not been prescribed the patch. While some patch manufacturers recommend flushing used patches down the toilet, this practice has raised concerns about drug product entering the water supply. In some states, "take back" programs have been instituted, allowing users to request shipping materials in order to ship used or unused pharmaceutical product (e.g., patches, pills, capsules) to a certified disposal company. These programs are costly and require several actions by the patient at multiple times.

SUMMARY

A first aspect of the present invention is embodied by a pharmaceutical product container (e.g., standard medication bottle, vessel, jar) that includes a cap (e.g., cover, lid), a container body, and a locking mechanism. The cap includes a cap body, and is movable relative to the container body between closed and open positions. The locking mechanism is disposable from an unlocked state to a locked state: 1) at least when the cap is in a closed position; 2) with the cap body remaining in a fixed position relative to the container body (i.e., the cap body need not be moved relative to the container body to activate the locking mechanism); and 3) by moving the locking mechanism relative to the cap body. The locking mechanism is unable to return from its locked state to its unlocked state at least when the cap is in its closed position. The cap may be repeatedly moved relative to the container body between its open and closed positions prior to the locking mechanism being disposed in its locked state.

A number of feature refinements and additional features are applicable to the first aspect of the present invention. These feature refinements and additional features may be used individually or in any combination. As such, each of the following features that will be discussed may be, but are not required to be, used with any other feature or combination of features of the first aspect of the present invention. If the cap is in the closed position and the lock is moved from its unlocked state to its locked state, the lock cannot be moved back to its unlocked state in the same general manner that it was moved into its locked stated. This may be viewed as "permanently" locking the pharmaceutical product container. Permanently locking the pharmaceutical product container at the completion of a medication regimen accommodates safer disposal of pharmaceutical product that remains within the pharmaceutical product container.

The locking mechanism may be part of the cap. In such a case, the "cap body" may be viewed as the remainder of the cap in relation to the locking mechanism. That is, the locking mechanism may be one part of the cap, and the cap body may be the remainder of the cap. In any case, the locking mechanism may be movable relative to the cap body to change from its unlocked state to its locked state. In one embodiment, a force that is external to the container (e.g., a manual force) is exerted on the locking mechanism to change the same from its unlocked state to its locked state.

The cap may be characterized as being detachably connectable to the container body (e.g., such that the cap may be repeatedly moved between its closed and open positions without damaging either the cap or the container body). When the cap is in its closed position, activation of the locking mechanism (by disposing the same in its locked state), may prevent the cap from being removed from the container body in its intended manner. That is, disposing the locking mechanism in the locked state (e.g., via a simple manual action) may attempt to permanently fix the cap to the container body such that a user may be unable to thereafter gain access to any pharmaceutical product within the enclosed space of the pharmaceutical product container. The locking mechanism may be actuated in any appropriate manner (e.g., mechanically, electronically) and may be associated with or located in any appropriate location (e.g., cap and/or container body). Numerous manners of permanently locking the cap to the container body to at least substantially limit access to pharmaceutical product within the container body exist.

In one arrangement, disposing the locking mechanism in the locked state provides a geometric interference between the cap and the container body that inhibits rotation of the cap relative to the container body in a direction and/or in an amount that would detach the cap from the container body (or otherwise allow the cap to be moved to its open position). In another variation of the geometric interference arrangement, the container body may include at least one locking segment (e.g., a single locking segment; a plurality of radially-spaced locking segments), and the cap may include a first locking tab (e.g., a rigid tab, a flexible or deflectable tab). The first locking tab may be disposable in an unlocking position where the first locking tab and the at least one locking segment are misaligned (an unlocked state for the locking mechanism), and a locking position where the first locking tab and the at least one locking segment are aligned (a locked state for the locking mechanism). The first locking tab may be closer to a central axis around which a sidewall of the container body is disposed when in the locking position versus the unlocking position. Here, having the first locking tab in the locking position inhibits rotation of the cap relative to the container body in a direction and/or in an amount that would detach the cap from the container body (or otherwise allow the cap to be moved to its open position). Stated otherwise, an end of the first locking tab may engage the locking segment when the first locking tab is disposed in the locking position and while attempting to rotate the cap relative to the container body in a direction that would detach the cap from the container body (or otherwise allow the cap to be moved to its open position). For instance, if a counterclockwise rotation of the cap relative to the container body would tend to detach the cap from the container body, the locking position of the locking tab may inhibit an amount of counterclockwise motion of the cap that would allow the same to be moved into its open position.

The geometric interference arrangement may also be designed such that the first locking tab is unable to return to the unlocking position from the locking position, at least if the cap is in its closed position when the locking mechanism is disposed in its locked state. For instance, the cap may further include a latch such that the first locking tab is disposed on a first side of the latch when the first locking tab is in the unlocking position, and such that the first locking tab is disposed on a second side of the latch when the first locking tab is in the locking position. In this regard, the first locking tab may be required to snap or otherwise deflect past the latch to move into the locking position. As a result, the first locking tab may be unable to return to the unlocking position from the locking position (e.g., the latch may block such a movement by the first locking tab). In one variation, the first locking tab may be aligned with an aperture of the cap such that the first locking tab may be directed through the aperture to move the first locking tab to the locking position.

In another arrangement, the locking mechanism in the locked state interacts with a seal disposed between the cap and the container body so as to incapacitate the seal or otherwise render the seal unusable in relation to allowing the cap to be moved to its open position. As a result, the cap may be limited from being pressed downwardly relative to the container body along a central axis of the container body an amount that would thereafter allow the cap to be rotated relative to the container body an amount such that the cap could be disposed in its open position (e.g., via being removed from the container body). Therefore, this incapacitation of the seal may be viewed as permanently locking the cap to the container body while in its closed position (e.g., by precluding the cap from being moved to its open position in the intended manner).

The locking mechanism may include an open space that is aligned with the above-noted seal. The open space may be accessible by the seal when the locking mechanism is in the unlocked state, and the open space may be inaccessible by the seal when the locking mechanism is in the locked state. For instance, the locking mechanism may be in the form of a movable plate, door, or slide, and the movable door may be movable between at least first and second door positions. In this regard, the door may be out of alignment with the open space in the first door position such that the open space is accessible by the seal, and may block access to the open space in the second door position such that the open space is inaccessible by the seal. Stated otherwise, the seal may be compressible by a first amount when the locking mechanism is in the unlocked state and by a second amount less than the first amount when the locking mechanism is in the locked state. A door lock may retain the door once moved into its second door position. Any appropriate door locking configuration may be utilized.

The above-noted movable door may be movable between the first and second door positions in a myriad of manners. In one variation, a sidewall of the container body is disposed about a central axis and the movable door moves along a movement axis that is generally perpendicular to the central axis. As another example, the movable door may rotate about a rotational axis that is generally collinear with the central axis. In either case, the movable door may include one of a notch and a projection, and the cap may include the other of the notch and the projection. In this situation, engagement of the notch with the projection may limit the movable door from moving from the second door position back to the first door position. In other words, this may aid in permanently locking the cap to the container body. Additionally, the movable door may include a first surface that is adapted to face away from an interior of the container body and a second surface that is adapted to face towards the interior of the container body, and the first surface may include a movement facilitation feature (e.g., tab, slot).

A second aspect of the present invention is embodied by a pharmaceutical product container (e.g., standard medication bottle, vessel, jar) that includes a cap (e.g., cover, lid), a container body, and a locking mechanism. The cap includes first and second sides or ends (e.g., oppositely disposed surfaces or structures). The first side includes a first connector configuration for interfacing with the container body to allow the cap to be moved (e.g., repeatedly) between open and closed positions. The second side of the cap incorporates a second connector configuration for interfacing with the container body. The locking mechanism is disposable from an unlocked state to a locked state. In this regard, when the second side of the cap interfaces with the container body, the locking mechanism is disposed in its locked state and is unable to return from its locked state to its unlocked state at this time.

A number of feature refinements and additional features are applicable to the second aspect of the present invention. These feature refinements and additional features may be used individually or in any combination. As such, each of the following features that will be discussed may be, but are not required to be, used with any other feature or combination of features of the second aspect of the present invention.

The first connector configuration associated with the first side or end of the cap may be a threaded connection, a "press and twist" arrangement, etc., while the second connector configuration associated with the second side or end of the cap may include the locking mechanism. Here, attaching the cap to the container body using the second connector configuration disposes the locking mechanism in its locked state. In this regard, the cap may be considered a "flip and lock" type cap. For protection and concealment, any appropriate cover (e.g., lid, hatch) may be disposed over the locking mechanism such that removal of the cover from a cap body of the cap exposes the second connector configuration (e.g., the second connector configuration may be concealed from view until use of the same is desired, at which time the cover may be removed to expose the second connector configuration). However, the locking mechanism could remain in an exposed state until the cap is "flipped" to interface the second connector configuration with the container body.

The second connector configuration and/or locking mechanism may include any appropriate component or combination of components that are selectively operable to permanently lock the cap to the container body. As an example, the second connector configuration may be in the form of at least one flexible latch (e.g., a cantilever) that is operable to grip onto or otherwise attach or connect to a corresponding structure on the container body. In one variation, a plurality of flexible latches are located around a perimeter of the cap. Each flexible latch may include a camming section and a locking section (e.g., a free end of the flexible latch). For instance and when a sidewall of the container body is disposed about a central axis, each flexible latch may move at least generally away from the central axis when positioning the cap on the container body by a movement of the cap relative to the container body at least generally along the central axis (e.g., via the camming section engaging with a portion of the container body), and then may move at least generally toward the central axis to dispose the locking mechanism in the locked state (e.g., via the locking section engaging with a portion of the container body). As another example, the container body may include at least one catch such that a first segment of relative motion between the cap and the container body along the central axis causes the catch to engage an aligned flexible latch (e.g., the camming section of the flexible latch) and move the aligned flexible latch at least generally away from the central axis. Continued relative motion between the cap and the container body along the central axis may result in the flexible latch moving at least generally toward the central axis after clearing an aligned catch to dispose the locking mechanism in the locked state (e.g., via the locking section of the flexible latch engaging with the catch).

A first motion type may be used to interconnect the cap and container body using the first connector configuration on the first side or end of the cap (e.g., rotational). A second motion type may be used to interconnect the cap and container body using the second connector configuration on the second side or end of the cap (e.g., axial, for instance collinear or parallel with a long axis of the container body). In one embodiment, the first and second motion types are different from each other.

A third aspect of the present invention is embodied by a pharmaceutical product container (e.g., standard medication bottle, vessel, jar) that includes a cap (e.g., cover, lid), a container body, and a locking mechanism disposable from an unlocked state to a locked state. The cap is repeatedly movable relative to the container body between closed and open positions when the locking mechanism is in an unlocked state. The container body includes at least one locking segment (e.g., a single locking segment; a plurality of radially-spaced locking segments), and the cap includes a first locking tab (e.g., a rigid tab, a flexible or deflectable tab). The first locking tab may be disposable in an unlocking position where the first locking tab and the at least one locking segment are misaligned (an unlocked state for the noted locking mechanism), and a locking position where the first locking tab and the at least one locking segment are aligned (a locked state for the noted locking mechanism). The features pertaining to the locking segment and first locking tab, discussed above in relation to the first aspect, may be utilized by the above-noted combination that defines the third aspect. The locking mechanism, utilized by the above-noted combination that defines the third aspect, may be configured such that it is unable to return to its unlocked state after being disposed in its locked state (at least if the cap is in its closed position when the locking mechanism changes from its unlocked state to its locked state).

A fourth aspect of the present invention is embodied by a pharmaceutical product container (e.g., standard medication bottle, vessel, jar) that includes a cap (e.g., cover, lid), a container body, and a locking mechanism disposable from an unlocked state to a locked state. The cap is repeatedly movable relative to the container body between closed and open positions when the locking mechanism is in an unlocked state. The pharmaceutical product container further includes a seal between the cap and container body, and the locking mechanism interacts with this seal, at least when the locking mechanism is in its locked state, in a manner that the cap cannot thereafter be moved to an open position. The features pertaining to this seal and the locking mechanism, discussed above in relation to the first aspect, may be utilized by the above-noted combination that defines the fourth aspect. The locking mechanism, utilized by the above-noted combination that defines the fourth aspect, may be configured such that it is unable to return to its unlocked state after being disposed in its locked state (at least if the cap is in its closed position when the locking mechanism changes from its unlocked state to its locked state).

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a locking mechanism includes "a latch" alone does not mean that the locking mechanism includes only a single latch). Moreover, any failure to use phrases such as "at least one" also does not limit the corresponding feature to the singular (e.g., indicating that a locking mechanism includes "a latch" alone does not mean that the locking mechanism includes only a single latch). Use of the phrase "at least generally" or the like in relation to a particular feature encompasses the corresponding characteristic and insubstantial variations thereof (e.g., indicating that a container body is at least generally cylindrical encompasses the container body being cylindrical). Finally, a reference of a feature in conjunction with the phrase "in one embodiment" does not limit the use of the feature to a single embodiment.

Pharmaceutical product may be enclosed within the container body by having the cap it its closed position. A "pharmaceutical product" as used herein may generally define any material or substance used in the course of a medical treatment, medical diagnosis, therapy, or the provision of any other appropriate medical care. A given material need not contain an active drug compound or ingredient to be considered a "pharmaceutical product" for purposes of the present invention.

A pharmaceutical product within the container may be in any appropriate form, in any appropriate dose, and of any appropriate type. A pharmaceutical product encompasses both a single-dose configuration (e.g., a single pill) and a multiple dose configuration (e.g., a plurality of pills). Pharmaceutical product may be in any appropriate form such as (but not limited to) pills, tablets, chewables, capsules, powders, fluids (e.g., liquids, suspensions, emulsions), patches (e.g., transdermal patches), films (e.g., transmucosal or buccal), strips (e.g., transmucosal or buccal), or the like. Further, a "pharmaceutical product" may refer to or include any "drug" as defined in Title 21 of the United States Code, Section 321(g)(1).

All pharmaceutical product within the container may be of at least substantially common dose. Alternatively, some pharmaceutical product could be of one dose (e.g., a prescribed dose), while some pharmaceutical product could be of a different dose (e.g., in the form of a transdermal patch that has been used by a patient, such that at least part of its original dosage has already been transdermally administered to a patient). All pharmaceutical product within the container could be in a common first condition. For instance and in the case of transdermal patches, all transdermal patches within the container could be contained within individual primary packaging (e.g., within a sealed pouch, jacket, foil wrapping, or the like), or all transdermal patches within the container could be in an exposed state (e.g., where the individual transdermal patches have been removed from their associated primary packaging before being disposed within the container). Some pharmaceutical product within the container could be in a common first condition, such as contained within individual primary packaging (e.g., within a sealed pouch, jacket, foil wrapping, or the like), while some pharmaceutical product within the container could be in a common second condition (e.g., in an exposed state or where the individual transdermal patches have been removed from their associated primary packaging before being disposed within the container).

Each transdermal patch that may be used in conjunction with the present invention may include any appropriate pharmaceutical product. Examples of appropriate pharmaceutical products that may be included in such transdermal patches include (but are not limited to): U.S. Drug Enforcement Administration (DEA) scheduled (e.g., Schedule II) drugs such as fentanyl, lidocaine, tetracaine, prilocalne, thebaine, buprenorphine, sufentanil, alfentanil, codeine, dihydrocodeine, hydrocodone, hydromorphone, levorphanol, methadone, morphine, nalbuphine, noscapine, opium, oxycodone, and propoxyphene; non-steroidal anti-inflammatory drugs (NSAIDs) such as ketoprofen, diclofenac, flurbiprofen, and ibuprofen; steroids such as testosterone and estradiol; psychoactive drugs such as buspirone; vitamins such as vitamin B12; vasodilators such as nitroglycerin; vaccines; antiemetics; capsaicin; and nicotine. Further, any transdermal patches utilized with the present invention can function to provide drug delivery in any appropriate manner. For instance, such transdermal patches may include those functioning via a passive delivery mechanism (e.g., pharmaceutical product located within the adhesive of the patch, within a reservoir of the patch, within a semisolid matrix (e.g., a gel)) or via an active delivery mechanism (e.g., iontophoresis, sonophoresis, electroporation, microneedles, abrasion, needle-less injection, suction, stretching, magnetophoresis, radio frequency, lasers, photomechanical waves, temperature (e.g., heat-activation)).

DETAILED DESCRIPTION

Various embodiments of pharmaceutical product containers will be described in relation to the accompanying figures. A pharmaceutical product container with pharmaceutical product therein may be referred to as a "pharmaceutical product supply." In any case, these pharmaceutical product containers are configured to store "pharmaceutical product" as described herein (e.g., in any appropriate form, in any appropriate dose, and of any appropriate type), and furthermore include one or more features to selectively "permanently lock" a pharmaceutical product container so as to limit a cap of the pharmaceutical product container from being removed from a container body of the pharmaceutical product container. As used throughout, the terms "permanent," "limit," "inhibit" or the like and variations thereof are used in the sense of at least substantially limiting or inhibiting access to an interior of the container body (and any pharmaceutical product inside the container body) in the manner traditionally used to gain access to the interior of such containers (e.g., pressing down on the cap and rotating the cap relative to the container body, depressing a tab and rotating the cap relative to the container body, flipping the cap upward relative to the container body). In this regard, the "permanent" locking arrangements and mechanisms discussed herein may not necessarily limit or inhibit access to the interior of the container body in the case of non-traditional access methods being used (e.g., via damaging one or more of the cap and container body). Additionally, "selectively" as used herein means that a user (e.g., patient) may voluntarily decide when to manually, permanently lock the container.

Figure 1:
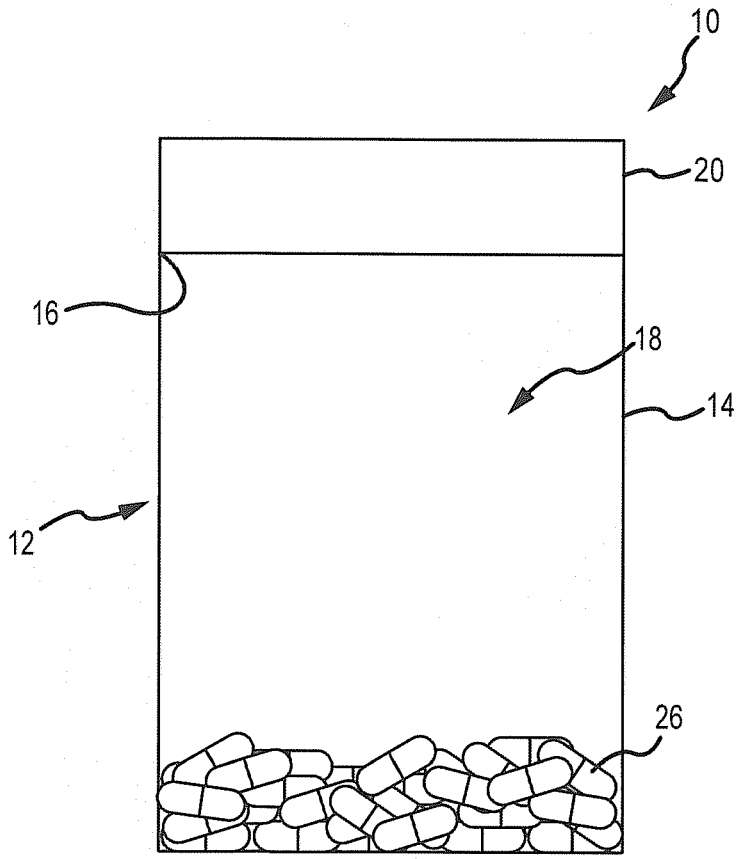
FIG. 1 is a schematic view of one embodiment of a pharmaceutical product supply.

FIG. 1 illustrates one embodiment of a pharmaceutical product supply 10 in the form of a pharmaceutical product container 12 (e.g., a standard medication bottle) that stores pharmaceutical product 26. The container 12 may include a container body 14 and a cap 20 (e.g., cover, lid) that may be interconnected with the container body 14 in any appropriate manner. Exemplary detachable interconnections include where an entirety of the cap 20 is threaded onto the container body 14, where the cap 20 is "snap fit" onto the container body 14, where there is an interference fit or press fit between the cap 20 and the container body 14, where the cap 20 is pivotally connected to the container body 14, or the like.

Each of the container body 14 and the cap 20 may be of any appropriate size, shape, configuration, and/or type, and furthermore may be formed from any appropriate material or combination of materials. Generally, the container body 14 includes an open end 16 through which pharmaceutical product 26 may be directed into and removed from an internal space 18 of the container body 14 when the cap 20 is in an open position (e.g. where the open end 16 of the container body 14 is exposed). When the cap 20 is in a closed position (as shown in FIG. 1), the cap 20 may close or seal off the open end 16 to enclose the pharmaceutical product 26 within the container 12 and/or limit access into and out of the internal space 18.

Figure 2:
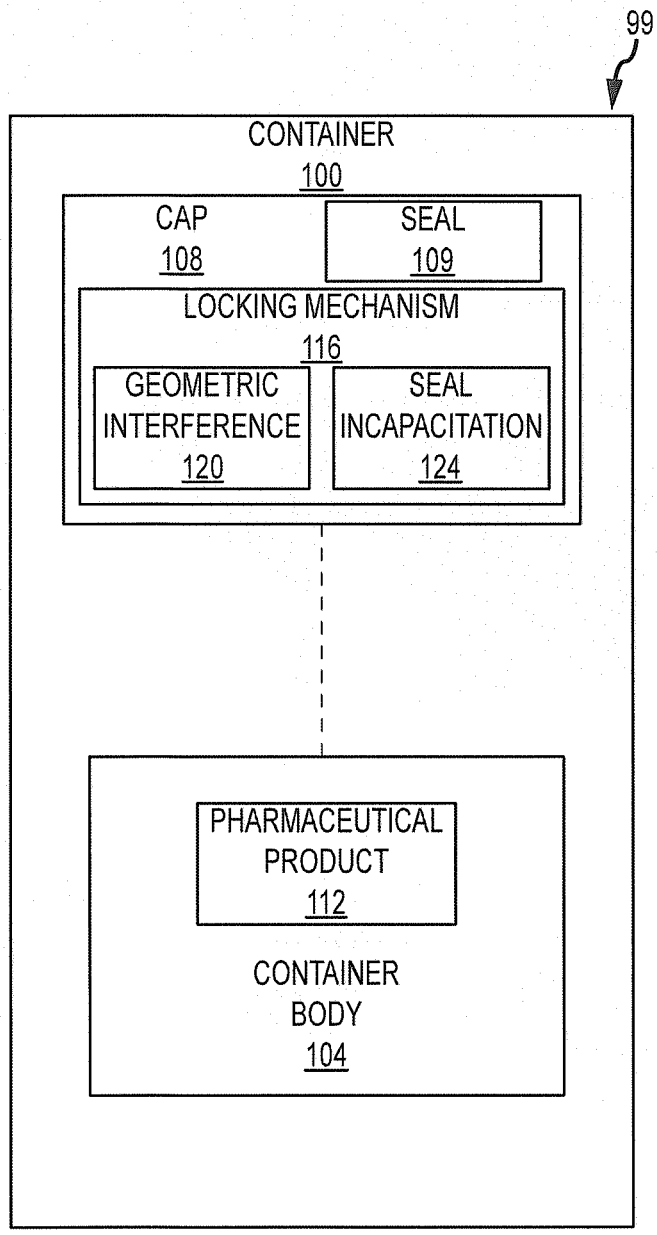
FIG. 2 is a schematic view of another embodiment of a pharmaceutical product supply.

FIG. 2 presents a schematic view of an embodiment of a pharmaceutical product supply 99 including a pharmaceutical product container 100 that is operable to be selectively permanently locked, by, for instance, a patient after the patient has stopped taking pharmaceutical product 112 within the container 100. For instance, the patient could be instructed (e.g., on the prescribing physician's instructions on a label on the container 100) to manually move or position the container 100 into a permanently locked position or configuration after a prescribed dosage period has expired or terminated. Thereafter, the patient could dispose of the container 100 in any appropriate trash or waste receptacle.

The container 100 generally may include a container body 104 and a cap 108, and pharmaceutical product 112 may be stored or received within the container body 104. At least in this regard, the container 100 may be similar to the pharmaceutical product container 12 of FIG. 1. The container body 104 may be of any appropriate size, shape, configuration, and/or type, and may be a common type of container structure for storing the pharmaceutical product 112. For example, the container body 104 may be in the form of a pill bottle or vial, a transdermal patch case, or the like. The cap 108 may also be of any appropriate design and may incorporate common features allowing the cap 108 to be "detachably interconnected" with the container body 104 (i.e., the cap 108 may be moved relative to the container body 104 and into an open position without damaging the cap 108, the container body 104, or any "joint" therebetween). For instance, the cap 108 may be threaded/screwed or press-fit onto the container body 104 (e.g., in the case of a pill bottle or vial) and/or may be pivoted and snapped onto the container body 104 (e.g., in the case of a transdermal patch case). Additionally, the cap may include a seal 109 for sealing an interface between the cap 108 and the container body 104, allowing the cap 108 to be pressed or moved downwardly and rotated relative to the container body 104 to allow removal of the cap 108 from the container body 104, etc. Generally, the cap 108 may be moved between open and closed positions in any appropriate manner (including where it remains attached to the container body 104 via a hinge or the like, or where it is totally removable from the container body 104).

The container 100 may also include a permanent locking mechanism 116 that can be selectively actuated or disposed by a user (e.g., patient) from an unlocked state to a locked state such that the locking mechanism 116 is unable to or is at least limited from being able to return to the unlocked state from the locked state; doing so permanently locks the container 100 (i.e., permanently affixes the cap 108 to the container body 104) to limit access to an interior of the container body 104 and any pharmaceutical product 112 thereinside. Stated otherwise, the permanent locking mechanism 116 may "override" the above-described common features that allow the cap 108 to be "detachably attached" to the container body 104 such that the common features are at least substantially inhibited from allowing the cap 108 to be moved into an open position in relation to the container body 104. As shown, the locking mechanism 116 may be contained within or at least associated with the cap 108 instead of the container body 104 to allow the same to be used with standard medication bottles while filling prescriptions, although the locking mechanism 116 could also be contained within or at least associated with the container body 104. The locking mechanism 116 may include one or more of a geometric interference locking arrangement 120 and a seal incapacitation locking arrangement 124. Each of these arrangements will be discussed in more detail below.

The geometric interference locking arrangement 120 may be any feature or combination of features operable to limit rotation of the cap 108 in relation to the container body 104 in a manner that would allow the cap 108 to be moved to an open position (e.g., in a direction and amount that would detach the cap 108 from the container body 104) to thus permanently affix the cap 108 to the container body 104. Some amount of relative movement between the cap 108 and container body 104 may be allowed—just not enough to allow the cap 108 to move to an open position. For instance, the geometric interference locking arrangement 120 may include one or more protrusions, latches, apertures, etc. that are operable to interact with one or more protrusions, latches, apertures, etc. on the container body 104. The seal incapacitation locking arrangement 124 may be used with caps 108 that include a compressible seal 109 that allows the cap 108 to be pressed downwardly before being rotated to be removed from the container body 104. In this regard, the seal incapacitation locking arrangement 124 may render the seal 109 at least substantially incompressible, or at least affects the compressibility of the seal 109 in a manner that precludes the cap 108 from being compressed relative to the container body 104 to a degree that would allow the cap 108 to be removed from the container body 104. That is, the cap 108 may be limited from being moved or pressed downwardly towards the container body 104, and may thus be permanently locked to the container body 104. It should be appreciated that the locking mechanism 116 may incorporate mechanical and/or electrical features (e.g., activation buttons, pre-set or programmable timers, wireless signals). In one embodiment, the locking mechanism 116 is manually activated, for instance by a user exerting a manual force to move the locking mechanism 116 from a position associated with an unlocked state, to a position associated with a locked state. While the various geometric interference locking arrangements and seal incapacitation locking arrangements will be described herein as being components of a cap, it should also be appreciated that the geometric interference locking arrangement and seal incapacitation locking arrangement could be considered a combination of components of the caps interacting with components of the container bodies.

In any event, FIGS. 3*a*-3*c* and 4*a*-4*c* illustrate perspective and sectional views of a pharmaceutical product container 200 incorporating a geometric interference locking arrangement 220 (shown in FIGS. 4*a*-4*c*) according to one embodiment. Similar reference numerals will be used when possible (e.g., container body 104 of FIG. 2 and container body 204 of FIG. 3*a*), which may imply that the referenced component includes some or all of the features of the earlier used reference numeral. The container 200 may include a container body 204 having a sidewall 205 disposed about a central axis 206. The container 200 may also include a cap 208 having a first side or end 228 with a first connector configuration 240 (e.g., a series of protrusions adapted to engage corresponding apertures or slots on the container body 204; threads to interact with corresponding threads on the container body 204) and a second side or end 232 with a second connector configuration 244 different from the first connector configuration 240 (shown in FIGS. 4*a*-4*c*). The first and second connector configurations 240, 244 may be contained or disposed within respective first and second cavities 241, 245 on the first and second sides 228, 232 such that each of the first and second sides 228, 232 can be disposed over the container body 204 and can at least partially extend along the sidewall 205 of the container body 204.

Figures 3A, 3B, 3C:
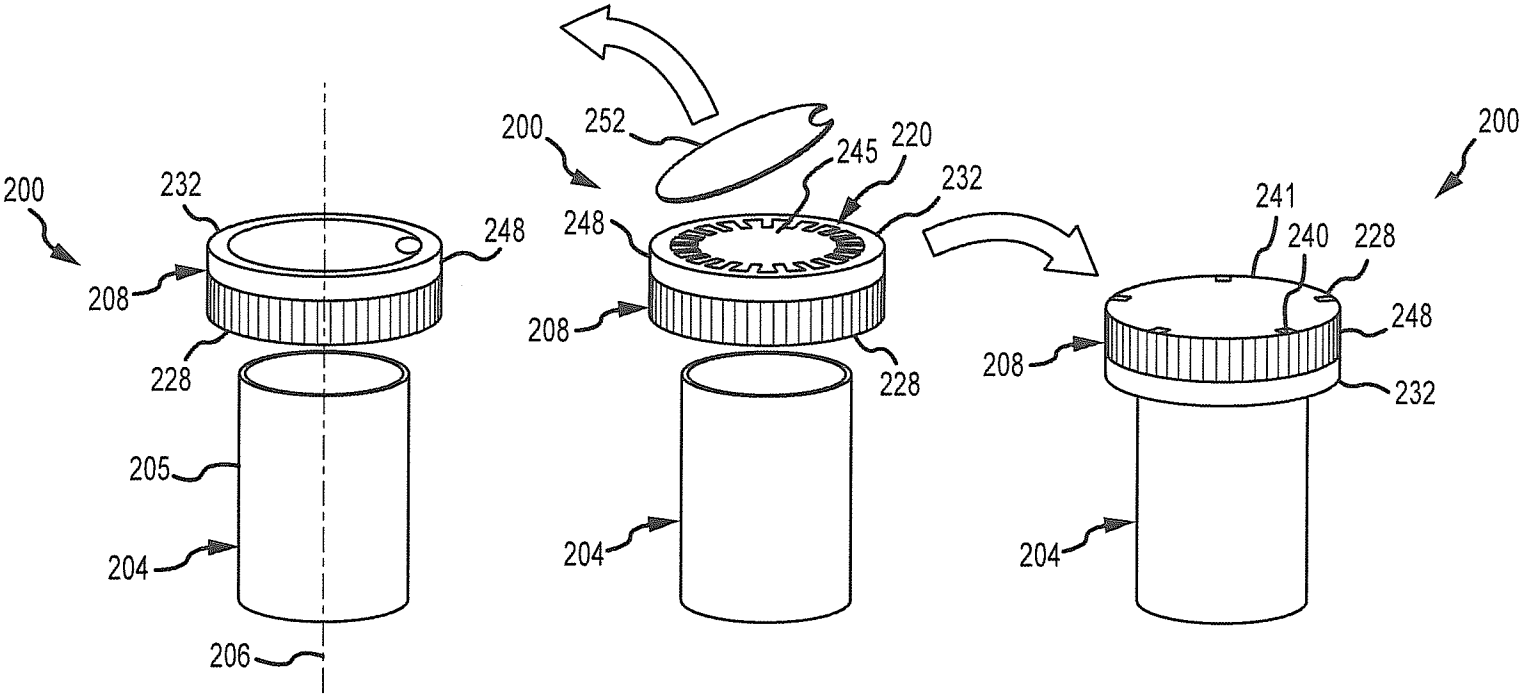
FIG. 3*a* is a perspective view of one embodiment of a pharmaceutical product container with a cap in a normal position before being permanently locked to a container body using a geometric interference locking arrangement.
FIG. 3*b* is a perspective view similar to FIG. 3*a*, but after removing a removable cover from the cap to expose the geometric interference locking arrangement.
FIG. 3*c* is a perspective view similar to FIG. 3*b*, but after flipping the cap upside down and pressing the cap down over a container body of the pharmaceutical product container.
Figure 4C:
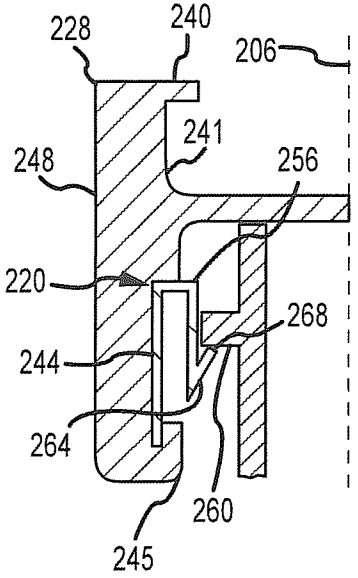
FIG. 4*c* is a sectional view similar to FIG. 4*b*, but showing the flexible latch of the cap after clearing the catch of the container body, thus permanently locking the cap to the container body.
Figure 4B:
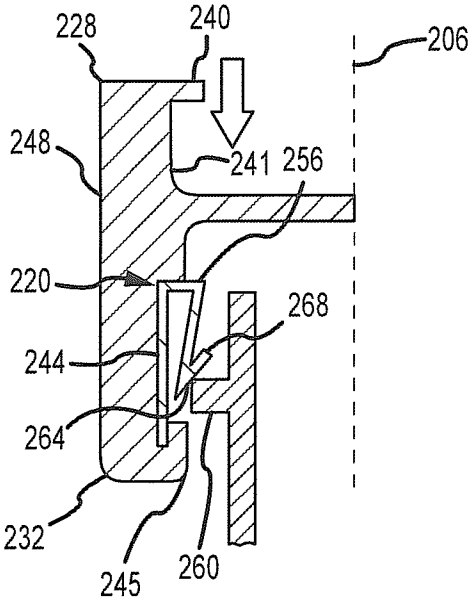
FIG. 4*b* is a sectional view along the line A-A of FIG. 4*a*, showing a flexible latch of the cap before clearing a catch of the container body.
Figure 4A:
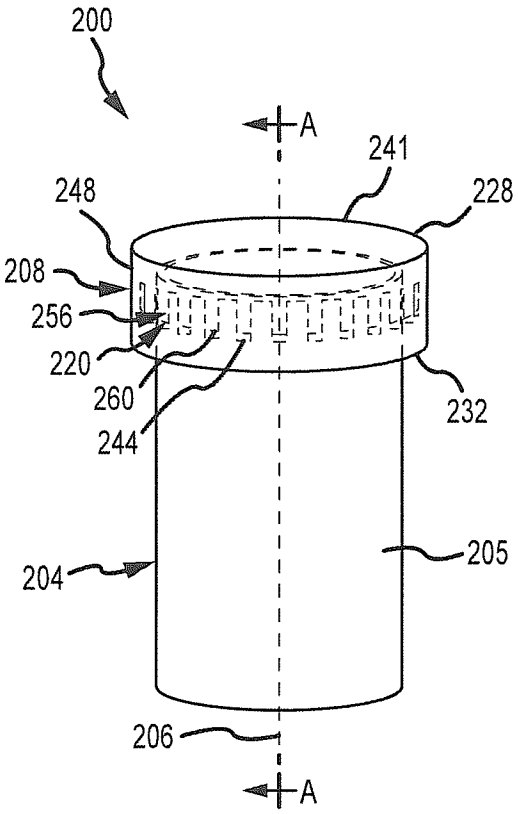
FIG. 4*a* is a perspective view of the pharmaceutical product container of FIG. 3*c*, showing the geometric interference locking arrangement in the form of a plurality of flexible latches on the cap engaging with a plurality of catches on the container body.
Figure 5B:
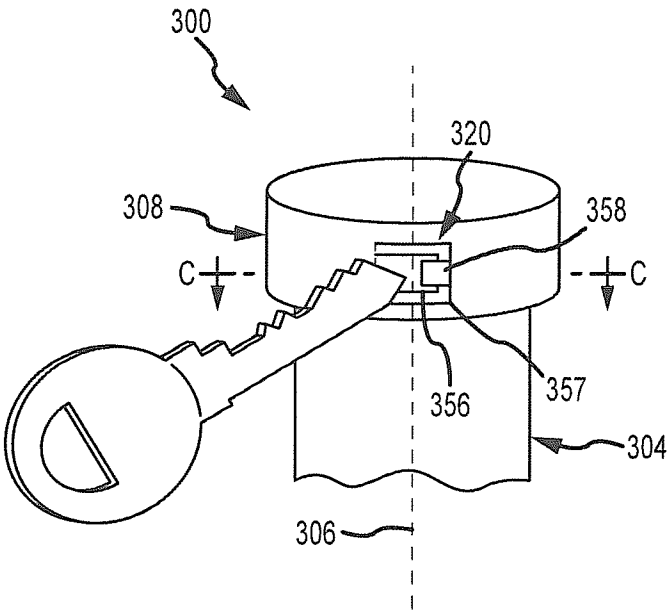
FIG. 5*b* is a perspective view of the pharmaceutical product container of FIG. 5*a* with a locking tab of the geometric interference locking arrangement having been pressed past a latch to permanently lock the cap to the container body.
Figure 5A:
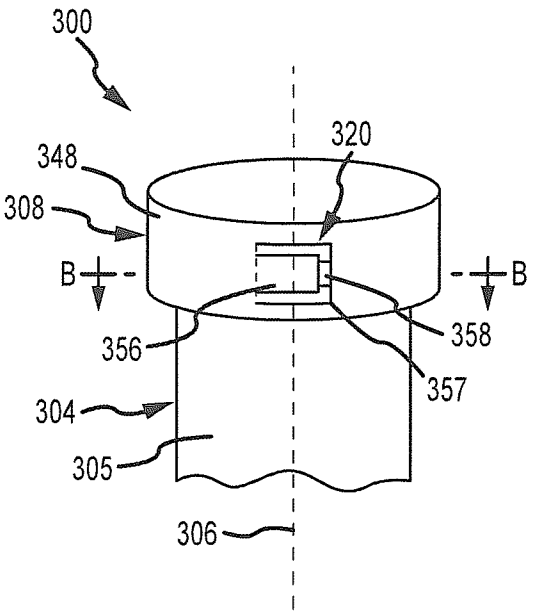
FIG. 5*a* is a perspective view of another embodiment of a pharmaceutical product container with a cap in a normal position before being permanently locked to a container body using another variation of a geometric interference locking arrangement.
Figure 6B:
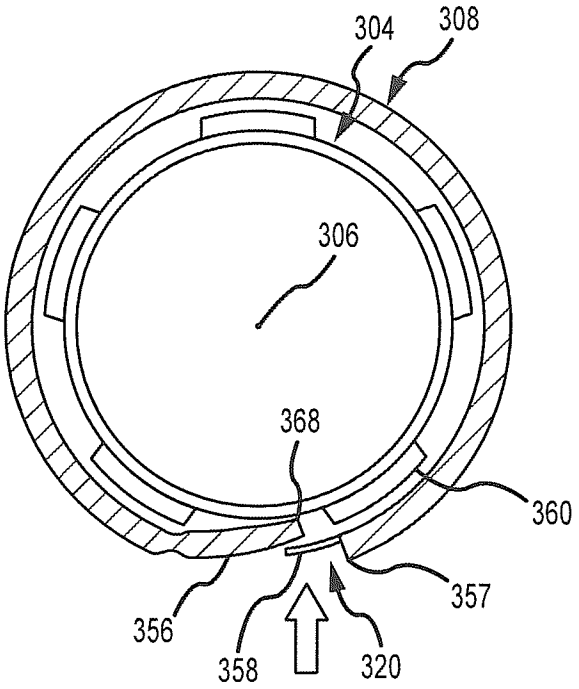
FIG. 6*b* is a cross-sectional view along the line C-C of FIG. 5*b*.
Figure 6A:
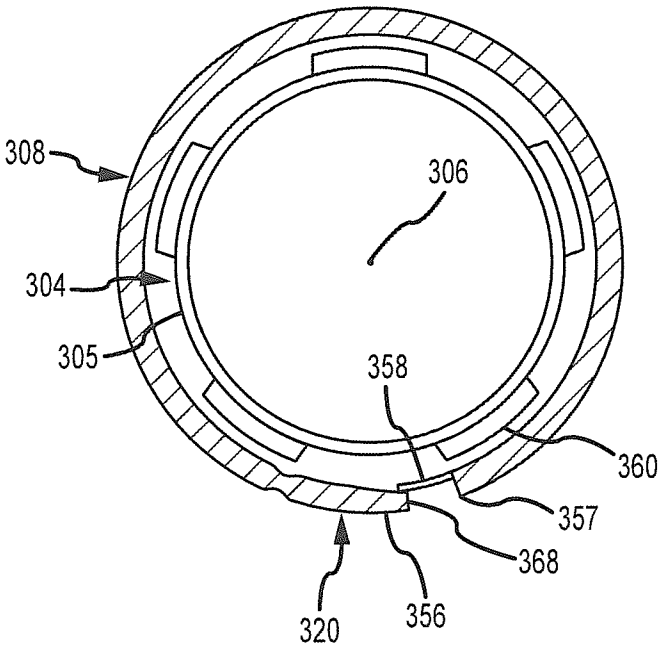
FIG. 6*a* is a cross-sectional view along the line B-B of FIG. 5*a*.
Figure 7B:
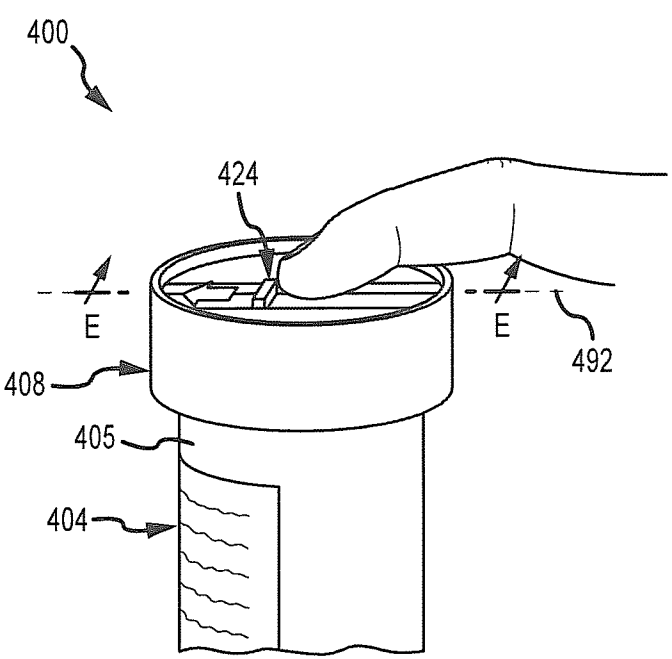
FIG. 7*b* is a perspective view of the pharmaceutical product container of FIG. 7*a* with a movable door of the seal incapacitation locking arrangement being moved into an open space between the cap and a seal to permanently lock the cap to the container body.
Figure 7A:
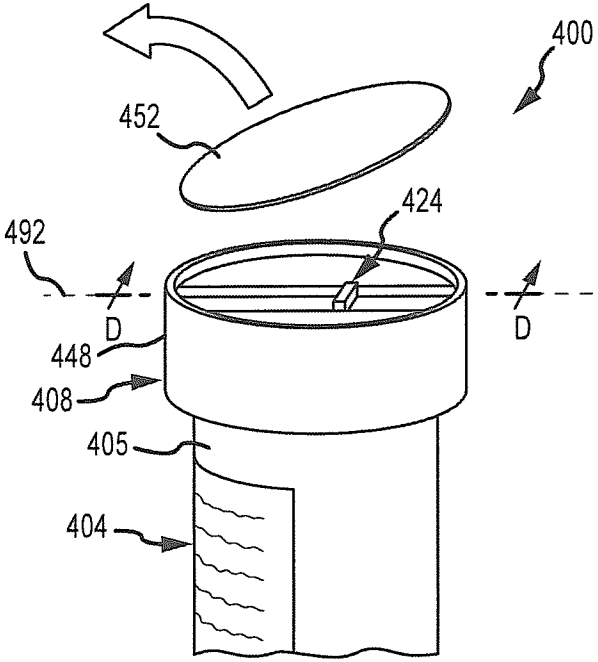
FIG. 7*a* is a perspective view of another embodiment of a pharmaceutical product container with a cap in a normal position before being permanently locked to a container body using a seal incapacitation locking arrangement.

For instance, the cap 208 may be detachably connectable with the container body 204 when the first side 228 interfaces with the container body 204 (e.g., if the cap 208 was interfaced with the container body 204 in the orientation shown in FIGS. 3*a*-3*b*), and interfacing the second side 232 of the cap 208 with the container body 204 disposes the geometric interference locking arrangement 220 in the locked state (e.g., as shown in FIGS. 3*c*, 4*a* and 4*c*). In this regard, the cap 208 may be considered a "flip and lock" cap, as a user may flip the cap 208 upside down such that the second side 232 faces the container body 204 and press the second side 232 of the cap 208 onto the container body 204 to dispose the geometric interference locking arrangement 220 into a locked state to permanently lock the cap 208 to the container body 204.

The cap 208 may include a cap body 248 and a removable cover 252 (shown in FIGS. 3*a*-3*b*) that may be removed from the cap body 248 to expose the second connector configuration 244. Turning to FIGS. 4*a*-4*c*, the second connector configuration 244 may include at least one flexible latch 256 (e.g., cantilever) for interfacing with a corresponding structure on the container body 204, and thus resisting removal of the cap 208 from the container body 204. The flexible latch 256 may be appropriately formed in the cavity 245 on the second side 232 (e.g., integrally formed, press-fit), and may be operable to interact with at least one catch 260 (e.g., medication bottle detent) on the container body 204. For instance, the flexible latch 256 may include a camming section 264 and a locking section 268 (e.g., a free end of the flexible latch 256). In operation and with reference to FIG. 4*b*, the second side 232 of the cap 208 may be pressed downwardly over the open end of the container body 204 along the central axis 206 until the flexible latch 256 engages the catch 260 (in some arrangements, this may necessitate appropriately lining up the flexible latch 256 with the catch 260).

Thereafter, continued movement of the cap 208 along the central axis 206 causes the flexible latch 256 to move at least generally away from the central axis 206 owing to the interaction of the camming section 264 with the catch 260. Stated otherwise, a first segment of relative motion between the cap 208 and the container body 204 causes the catch 260 to engage an aligned flexible latch 256 and move the flexible latch 256 at least generally away from the central axis 206. In any event, continued movement of the cap 208 along the central axis 206 results in the locking section 268 eventually clearing the aligned catch 260, which disposes the geometric interference locking arrangement 220 in the locked (i.e., permanently locked) state. That is, any attempt to pull the cap 208 away from the container body 204 (e.g., along the central axis 206) would result in the locking section 268 contacting the catch 260, thus inhibiting movement of the cap 208 to its open position.

Although not shown, the catch 260 may include an aperture or bore that is sized to snugly receive the locking section 268. Such an aperture or bore may serve to further reduce both movement of the cap 208 along the central axis 206 and rotational movement of the cap 208 about the central axis 206 in a manner that would allow the cap 208 to be moved into its open position. It should be appreciated that as the cap 208 was already pressed or moved downwardly along the central axis 206 for the locking section to clear the catch 260, the cap 208 may be at least generally inhibited from further movement downward along the central axis 206. This feature reduces the likelihood of disengagement of the flexible latch 256 from the catch 260 and thus removal of the cap 208 from the container body 204. In one arrangement, a plurality of flexible latches 256 may be disposed about a perimeter of the cavity 245 of the second side 232 of the cap 208, one or more of which may engage with one or more catches 260 disposed about a periphery of the container body 204. For instance, the plurality of flexible latches 256 may be appropriately formed or disposed on a ring (not shown), and the ring may be, for instance, press-fit into the cavity 245 on the cap 208.

FIGS. 5*a*-5*b* and 6*a*-6*b* illustrate partial perspective and sectional views of a pharmaceutical product container 300 incorporating a geometric interference locking arrangement 320 according to another embodiment. Similar reference numerals will be used when possible which may imply that the referenced component includes some or all of the features of the earlier used reference numeral. With initial reference to FIGS. 5*a* and 6*a*, the container 300 may include a container body 304 having a sidewall 305 disposed about a central axis 306, the sidewall 305 having a plurality of radially-spaced locking segments 360 disposed about the sidewall 305. The container 300 may also include a cap 308 disposable over the container body 304 and having a cap body 348, and the geometric interference locking arrangement 320 may be disposed within a portion of the cap body 348 (e.g., a sidewall of the cap 308).

The geometric interference locking arrangement 320 may include at least one first locking tab 356 (e.g., a deflectable tab) on the cap body 348 that is disposable in at least unlocking and locking positions. For instance, the unlocking position may be when the first locking tab 356 and at least one of the locking segments 360 are misaligned (see FIG. 6*a*), and the locking position may be when the first locking tab 356 and the locking segment 360 are at least generally aligned (see FIG. 6*b*). As will be appreciated with reference to FIG. 6*b*, having the first locking tab 356 in the locking position inhibits rotation of the cap 308 relative to the container body 304 in a manner so as to permanently lock the cap 308 to the container body 304, as an attempt to rotate the cap 308 relative to the container body 304 (in a counterclockwise direction in FIG. 6*b* that would detach the cap 308 from the container body 304) would result in an end 368 of the first locking tab 356 abutting or engaging the locking segment 360 and disallowing further rotation. It should be appreciated that some amount of relative rotation may occur before the first locking tab 356 engages a locking segment 360—just not an amount of relative rotational movement that would allow the cap 308 to be removed from the container body 304 or otherwise moved into its open position.

Of course, the first locking tab 356 could be oriented or disposed on the cap body 348 so as to protrude in an opposite direction in the case where rotating the cap 308 in a clockwise direction relative to the container body 304 would tend to detach the cap 308 from the container body 304. In some arrangements, a second or additional locking tabs 356 could be provided at various radial positions in the cap body 348, all of which may protrude in the same direction or some of which may protrude in one direction and some of which may protrude in other directions. In some arrangements, the locking tabs 356 may be arranged or designed so as to protrude upwardly so that when pressed inwardly so as to at least generally align with a corresponding locking segment 360 on the container body 304, an attempt to move the cap 308 away from the container body 304 along the central axis 306 would result in the locking tabs 356 engaging the corresponding locking segment 360 and thus disallowing removal of the cap 308.

To move the first locking tab 356 from the unlocking position to the locking position, the first locking tab 356 may be pressed inwardly towards the central axis 306 of the container body 304 in any appropriate manner (e.g., using a fingernail or a key) such that the first locking tab 356 is closer to the central axis 306 in the locking position than in the unlocking position. For example, the first locking tab 356 may be disposed within or aligned with an aperture 357 in the cap body 348 such that the first locking tab 356 may be directed through the aperture 357 to move the first locking tab 356 to the locking position.

Additionally, the geometric interference locking arrangement 320 may be designed such that the first locking tab 356 is unable to return to the unlocking position from the locking position. For instance, the cap body 348 may include a latch 358 (e.g., tab, catch, protrusion), which may be disposed in or aligned with the aperture 357 and which may be operable to limit or block the first locking tab 356 from returning to the unlocking position from the locking position (shown in FIGS. 5*b* and 6*b*). In operation and when the first locking tab 356 is disposed on a first side of the latch 358 in the unlocking position (shown in FIGS. 5*a* and 6*a*), the first locking tab 356 may be pressed inwardly past the latch 358 so as to be disposed on a second side of the latch 358 in the locking position. As the first locking tab 356 at this point generally is unable to return to the first side of the latch 358, the first locking tab 356 is aligned with the locking member 360 of the container body 304, which limits rotation of the cap 308 relative to the container body 304 and thus removal of the cap 308 from the container body 304. Other arrangements for limiting the first locking tab 356 from returning to the unlocking position are also contemplated (e.g., one or more notches on the container body 304 that the end 368 of the first locking tab 356 fits into).

FIGS. 7*a*-7*b* and 8*a*-8*b* illustrate partial perspective and sectional views of a pharmaceutical product container 400 incorporating a seal incapacitation locking arrangement 424 according to another embodiment. Similar reference numerals will be used when possible which may imply that the referenced component includes some or all of the features of the earlier used reference numeral. With initial reference to FIGS. 7*a* and 8*a*, the container 400 may include a container body 404 having a sidewall 405 disposed about a central axis 406. Additionally, the container 400 may include a cap 408 disposable over the container body 404 and having a cap body 448 and a seal 409 that is adapted to be disposed between the cap 408 and the container body 404 (e.g., when the cap 408 is disposed over the container body 404), and the seal incapacitation locking arrangement 424 may be disposed within or associated with a portion of the cap body 448. A removable cover 452 may be included on the cap body 448 for selectively covering and exposing the seal incapacitation locking arrangement 424.

As the name suggests, the seal incapacitation locking arrangement 424 is adapted to interact with and incapacitate the seal 409 to permanently lock the container 400 (i.e., limit the cap 408 from being removed from the container body 404). With particular reference to FIG. 8*a*, the seal incapacitation locking arrangement 424 may include an open space 472 that is aligned with the seal 409 and that is accessible by the seal 409 when the seal incapacitation locking arrangement 424 is in an unlocked state. As discussed earlier, a cap of a container is sometimes required to be first pushed or pressed downwardly towards the container body along a central axis of the container body before the cap can be rotated and finally removed from the container body. Here, as part of the downward movement of the cap 408 relative to the container body 404, the seal 409 "accesses" the open space 472 and can be compressed by the cap body 448 to allow such downward movement of the cap 408 relative to the container body 404.

When the seal incapacitation locking arrangement 424 is in a locked state, the seal 409 may be unable to access the open space 472, and thus the seal 409 may not be able to be compressed to a degree that allows the cap 408 to be removed from container body 404. In this regard, the container 400 may be permanently locked because the cap 408 may not be able to be moved downwardly along the central axis 406. In one arrangement, the seal incapacitation locking arrangement 424 may include a moveable door, slide, or plate 476 disposed within or associated with the cap 408 that may be operable to enter the open space 472. That is, the movable door 476 may be able to transition between at least a first door position where the movable door 476 is out of alignment with the open space 472 and the seal 409 is compressible by the cap body 448 by a first amount (as in FIGS. 7*a* and 8*a*), and a second door position where the movable 476 door blocks access to the open space 472 by the seal 409 and the seal 409 is compressible by the cap body 448 by a second amount that is less than the first amount (as in FIGS. 7*a* and 8*b*). More specifically and with reference to FIG. 8*b*, because the movable door 476 has already compressed the seal 409 by an amount equal to the difference in thickness of the seal 409 between FIGS. 8*a* and 8*b*, the cap 408 may be generally unable to further compress the seal 409 by an amount that allows the cap 408 to be removed from the container body 404. In other words, the second amount that the seal 409 can be compressed by the cap 408 after the seal 409 has already been compressed by the movable door 476 resists removal of the 408 cap from the container body 404.

Figure 8B:
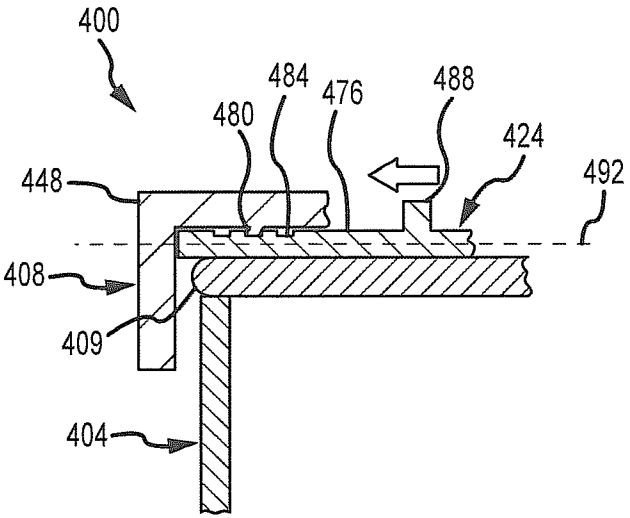
FIG. 8*b* is a cross-sectional view along the line E-E of FIG. 7*b*.
Figure 8A:
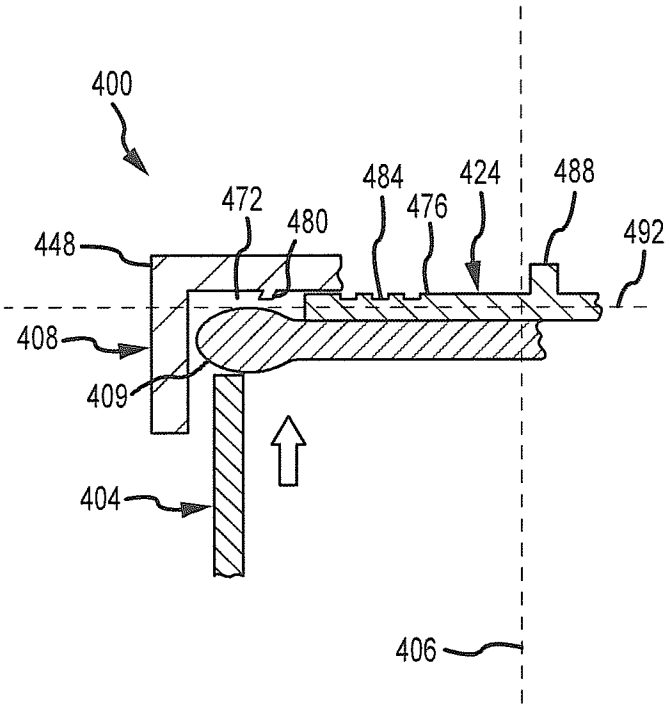
FIG. 8*a* is a cross-sectional view along the line D-D of FIG. 7*a*.

The movable door 476 need not be a single piece of generally constant thickness as shown in FIGS. 8*a* and 8*b*. For instance, the movable door 476 may include a thin strip of any appropriate material that may be operable to be slid into the open space 472. Additionally, the movable door 476 may in other embodiments be moved or slid under the seal 409 instead of over or on top of the seal 409 as shown in FIGS. 8*a* and 8*b*. Accordingly, the open space 472 would in this situation be located under the seal 409 as well.

Further, and even though the movable door 476 may already be wedged between the cap body 448 and the seal 409 and thus be resistant to movement back to the first door position (e.g., as shown in FIG. 8*a*), any appropriate mechanism or combination of mechanisms can be included as part of the seal incapacitation locking arrangement 424 to further limit the movable door 476 from moving back to the first door position. For instance, the cap body 448 may include at least one projection 480 (or a protrusion, tooth, etc.) and the movable door 476 may include at least one notch 484 (or an aperture, bore, etc.) sized for receipt of the projection 480. As shown, the movable door 476 may include a series of notches 484. In operation, the movable door 476 may be moved into the open space 472 such that the projection 480 moves or ratchets into one of the notches 484. Once the projection 480 has entered one of the notches 484, any attempt to move the movable door 476 back to the first door position would result in the projection 480 abutting a wall of a notch 484 which would further resist movement of the movable door 476 back to the first door position and possible removal of the cap 408 from the container body 404. As seen in FIGS. 8*a* and 8*b*, the projection 480 may be designed to protrude at least partially away from the first door position which may further limit movement of the movable door 476 back to the first door position once the projection 480 has entered one of the notches 484. Of course, the parts could be reversed such that the one or more projection 480 are appropriately disposed on the movable door 476 and the one or more notches are disposed on the cap body 448.

Any appropriate movement facilitation feature may be disposed and/or formed on the movable door 476 to aid a user in moving the door into the second door position. For instance, the movable door may include a tab 488 protruding therefrom which may be gripped or pressed by a user to slide or otherwise move the movable door 476. The tab 488 may be disposed on a first surface that faces away from an interior of the container body 404 which may face away from a second surface that faces towards the interior of the container body 404.

Figure 9B:
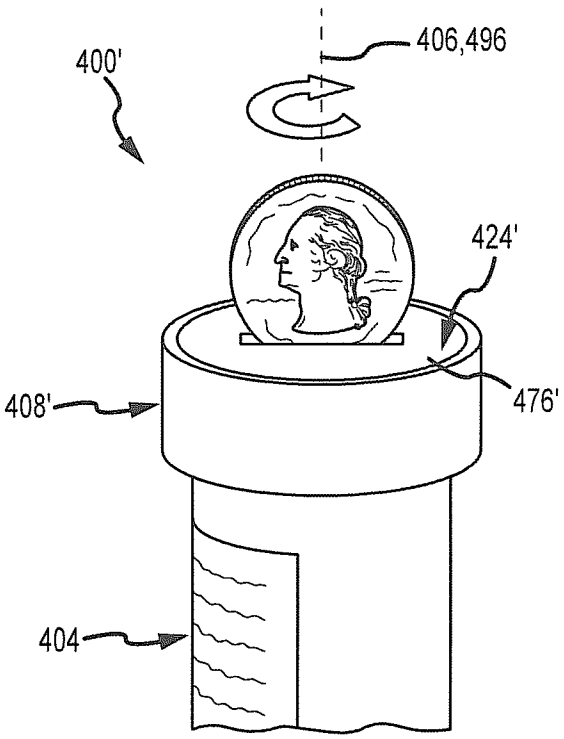
FIG. 9*b* is a perspective view of the pharmaceutical product container of FIG. 9*a* with a coin being inserted into a slot on a movable door of the seal incapacitation locking arrangement.
Figure 9A:
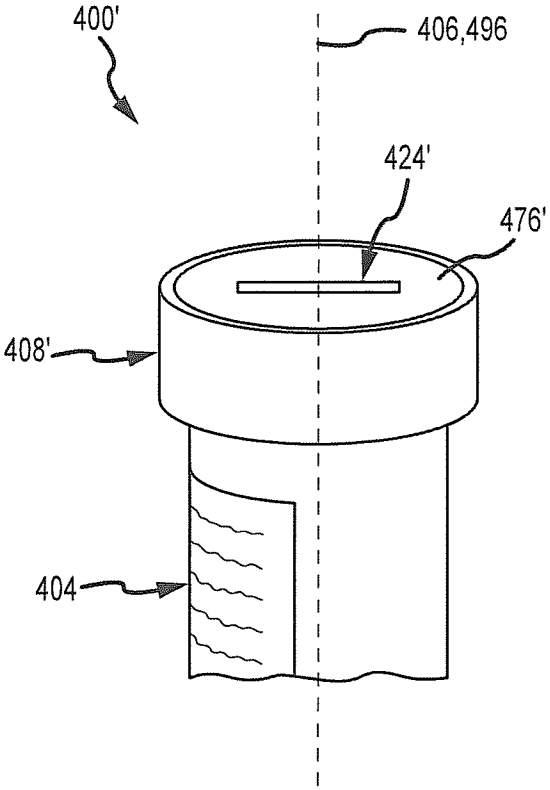
FIG. 9*a* is a perspective view of another embodiment of a pharmaceutical product container with a cap in a normal position before being permanently locked to a container body using another variation of a seal incapacitation locking arrangement.
Figure 10B:
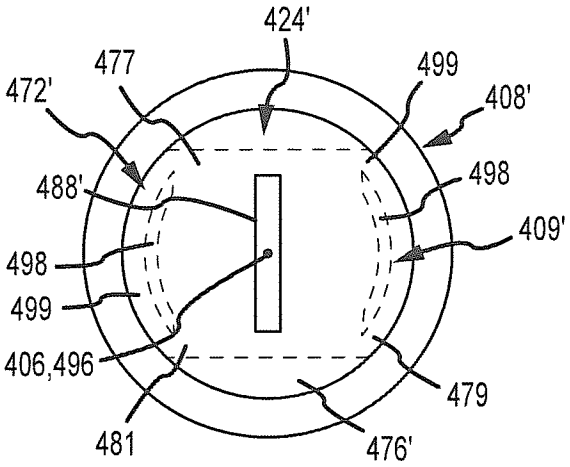
FIG. 10*b* is a plan view similar to FIG. 10*a*, but after the movable door has been rotated to a second door position to permanently lock the cap to the container body.
Figure 10A:
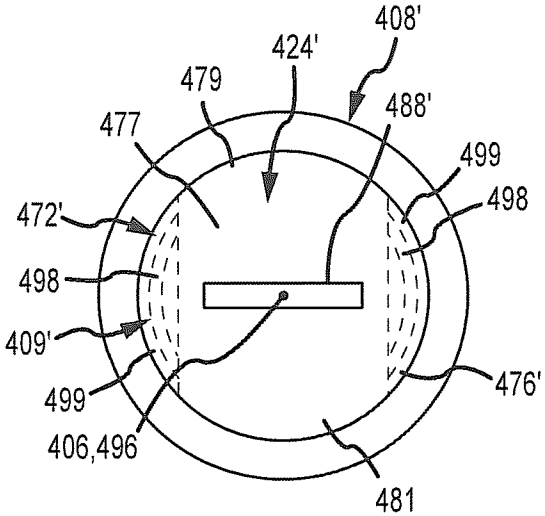
FIG. 10*a* is a plan view of the pharmaceutical product container of FIG. 9*a*.

Additionally, while the movable door 476 is shown as being movable along a movement axis 492 that is generally perpendicular to the central axis 406, other arrangements are also envisioned. For example and with reference now to FIGS. 9*a*-9*b* and 10*a*-10*b*, another embodiment of a pharmaceutical product container 400' incorporating a seal incapacitation locking arrangement 424' is shown. Corresponding components between the embodiments of FIGS. 7*a*-7*b*/8*a*-8*b* and 9*a*-9*b*/10*a*-10*b* are identified by common reference numerals. Those corresponding components that differ in at least some respect from the embodiment of FIGS. 7*a*-7*b*/8*a*-8*b* are identified by a "single prime" designation in FIGS. 9*a*-9*b*/10*a*-10*b*. As with the pharmaceutical product container 400, the one or more components of the pharmaceutical product container 400' may be of any appropriate size, shape, configuration, and/or type. Differences between the container 400 of FIGS. 7*a*-7*b*/8*a*-8*b* and the container 400' of FIGS. 9*a*/9*b*/10*a*/10*b* include: a) a seal incapacitation locking arrangement 424' including a movable door 476' (e.g., dial) that rotates about a rotational axis 496 that is at least generally collinear with the central axis 406 associated with the container body 404; b) a movement facilitation feature in the form of a slot 488' on the first surface of the movable door 476'; c) a seal 409' including at least two spaced seal segments 498; and d) an open space 472' including at least two spaced portions 499 corresponding to the two spaced seal segments 498 of the seal 409'.

In this embodiment, the movable door 476' may be rotated (e.g., via a coin or the like being inserted into the slot 488') either clockwise or counterclockwise from a first door position to a second door position. In the first door position (FIG. 10*a*), the movable door 476' is not disposed in the open space 472', and thereby does not contact and/or compress the seal 409' which allows the cap 408' to be pressed downwardly along the central axis 406 and opened. In the second door position (FIG. 10*b*), one or more seal interface portions of the movable door 476' may move into the open space 472' to compress the seal 409' and thereby permanently lock the cap 408' to the container body 404 as discussed in the embodiment of FIGS. 7*a*-7*b*/8-*a*8*b*. For instance, the movable door 476' may include a locking portion 477 with first and second seal interface portions 479, 481 (e.g., end portions of the locking portion 477) on an underside of the movable door 476'. The first and second seal interface portions 479, 481 may be disposed out of the spaced portions 499 of the open space 472' in the first door position (FIG. 10*a*; e.g., the seal interface portions 479, 481 of the door 476' are not aligned with the spaced portions 499 of the open space 472' at this time). The first and second seal interface portions 479, 481 may enter the spaced portions 499 of the open space 472' in the second door position (FIG. 10*b*; e.g., the seal interface portions 479, 481 of the door 476' are aligned with the spaced portions 499 of the open space 472' at this time). In the second door position of FIG. 10*b*, the seal interface portions 479, 481 of the door 476' now compress the spaced seal segments 498 of the seal 409' to thereby lock the cap 408' to the container body 404. More than two seal interface portions may be used by the locking portion 477 of the movable door 476'. More than two seal segments 498 of the seal 409' and corresponding spaced portions 499 of the open space 472' may be used as well. Furthermore, a tab 488 could be used in place of the slot 488' to allow a user to twist the movable door 476' from the first to the second door position using, for instance, a thumb and an index finger.

It should be appreciated that any features of any of the embodiments and arrangements may be used in conjunction with any of the other embodiments. As merely one example, a container having a container body and a cap may include both a geometric interference locking arrangement 220 of FIGS. 3*a*-3*c*/4*a*-4*c* and a geometric interference locking arrangement 320 of FIGS. 5*a*-5*b*/6*a*-6*b*. As another example, any combination of the geometric interference locking arrangements and the seal incapacitation locking arrangements may be used to permanently lock a cap to a container body.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A pharmaceutical product container, comprising:

a cap comprising a cap body;

a container body; and a locking mechanism disposable from an unlocked state to a locked state at least when said cap is in a closed position, with said cap body remaining in a fixed position relative to said container body, and by moving said locking mechanism relative to said cap body, wherein said locking mechanism is unable to return to said unlocked state from said locked state with said cap being in said closed position, and wherein said cap is repeatedly movable relative to said container body between said closed position and an open position prior to said locking mechanism being disposed in said locked state; further comprising: a seal between said cap and said container body, wherein said locking mechanism interacts with said seal; wherein said locking mechanism comprises an open space that is aligned with said seal, wherein said open space is accessible by said seal when said locking mechanism is in said unlocked state, and wherein said open space is inaccessible by said seal when said locking mechanism is in said locked state; wherein said locking mechanism comprises a movable door, wherein said door is out of alignment with said open space in a first door position, and blocks access to said open space in a second door position; wherein a sidewall of said container body is disposed about a central axis, and wherein said movable door moves along a movement axis that is perpendicular to said central axis.

2. The pharmaceutical product container of claim 1, wherein said cap comprises said locking mechanism.

3. The pharmaceutical product container of claim 1, wherein said movable door comprises one of a notch and a projection, and said cap comprises the other of said notch and said projection, and wherein engagement of said notch with said projection limits said movable door from moving from said second door position to said first door position.

4. The pharmaceutical product container of claim 1, wherein said movable door comprises a first surface that is adapted to face away from an interior of said container body and a second surface that is adapted to face towards said interior of said container body, and wherein said first surface comprises a movement facilitation feature.

5. The pharmaceutical product container of claim 1, wherein said locking mechanism further comprises a door lock that is activated when said door is disposed in said second door position.

6. The pharmaceutical product container of claim 1, wherein said seal is compressible by a first amount when said locking mechanism is in said unlocked state, wherein said seal is compressible by a second amount when said locking mechanism is in said locked state, and wherein said second amount is less than said first amount.

7. The pharmaceutical product container of claim 6, wherein said second amount resists removal of the cap from the container body.

* * * * *